US008607802B2

(12) United States Patent
Banks et al.

(10) Patent No.: US 8,607,802 B2
(45) Date of Patent: Dec. 17, 2013

(54) FIBRE

(75) Inventors: Andrew John Banks, Michleover (GB); Craig Day, South Normanton (GB); John Travers, Spondon (DE)

(73) Assignee: Celanese Acetate Limited, London (GB)

( * ) Notice: Subject to any disclaimer, the term of this patent is extended or adjusted under 35 U.S.C. 154(b) by 1348 days.

(21) Appl. No.: 11/813,097

(22) PCT Filed: Dec. 28, 2005

(86) PCT No.: PCT/GB2005/005096

§ 371 (c)(1),
(2), (4) Date: Nov. 29, 2007

(87) PCT Pub. No.: WO2006/070194

PCT Pub. Date: Jul. 6, 2006

(65) Prior Publication Data

US 2008/0202539 A1 Aug. 28, 2008

(30) Foreign Application Priority Data

Dec. 29, 2004 (GB) ..... 0428408.9

(51) Int. Cl.
*A24B 15/18* (2006.01)

(52) U.S. Cl.
USPC ..... 131/334; 131/332; 131/345

(58) Field of Classification Search
None
See application file for complete search history.

(56) References Cited

U.S. PATENT DOCUMENTS

| | | | | |
|---|---|---|---|---|
| 2,881,770 | A | | 4/1959 | Touey |
| 3,101,723 | A | | 8/1963 | Seligman et al. |
| 4,700,723 | A | | 10/1987 | Yoshikawa et al. |
| 6,162,538 | A | * | 12/2000 | LaNieve et al. ..... 428/373 |

FOREIGN PATENT DOCUMENTS

| | | | |
|---|---|---|---|
| CN | 1296790 | A | 5/2001 |
| CN | 1407147 | A | 4/2003 |
| DE | 19726515 | A1 | 1/1998 |
| EP | 0118972 | A2 | 9/1984 |
| GB | 1392555 | | 4/1975 |
| JP | 43-014185 | B | 6/1943 |
| JP | 44-001949 | B | 1/1944 |
| JP | 55018327 | A | 8/1980 |
| JP | 59-166073 | A | 9/1984 |
| JP | 4338236 | A | 11/1992 |
| JP | 09-195125 | A | 7/1997 |
| JP | 11-507994 | A | 7/1999 |
| JP | 2001-146626 | A | 5/2001 |
| WO | WO 03/047836 | A1 | 6/2003 |

* cited by examiner

*Primary Examiner* — Michael J Felton
(74) *Attorney, Agent, or Firm* — Hammer & Associates, P.C.

(57) ABSTRACT

A method for forming a polycomponent fiber comprising a first, fiber-forming component comprising a polymer, and a second, component comprising an active ingredient that will selectively reduce or remove components of tobacco smoke, the method comprising the steps of: i. forming a dispersion, second solution or liquid comprising the second component; and ii. coextruding the first component and the dispersion, second solution or liquid through a jet or aperture to form a fiber comprising a first portion formed from the first component, and a second portion formed from the second component.

10 Claims, 6 Drawing Sheets

SCHEMATIC OF ONE END OF POLYCOMPONENT FIBRE EXTRUSION

Key

= First component

= Second component

FIBRE

This invention relates to a polycomponent fibre or filament and particularly, but not exclusively, to a bicomponent fibre or filament used to form a crimped tow of filaments known as filter tow, for conversion into filter rods for use as tobacco smoke filters.

In this specification, the term "fibre" should be understood to include the term "filament" and vice versa.

The most commonly used filter tow comprises cellulose acetate fibres which are valued for their ability to product high quality filters.

Cellulose acetate flake is dissolved in acetone to form a cellulose acetate solution referred to as "dope". The solution is then spun, or extruded through precise microscopic holes or jets, in metal spinnerettes. Next, the solution is drawn into long thin fibres. These acetate fibres are then heated in a heating chamber to dry. A tow band is formed by combining a large number of such fibres and crimping the fibres to create an integrated band of continuous fibres. The tow band is then dried, plaited and baled.

The tow may be formed into filter rods by a rod maker, and then incorporated into cigarettes, for example.

It is known to increase the efficiency of a tobacco smoke filter by adding an active ingredient to the crimped tow fibres. The addition of an active ingredient allows selective filtration, which in turn enables a reduction in the levels of certain constituents of cigarette smoke to be achieved. The active ingredient may comprise a plurality of porous particles having absorbent/adsorbent surfaces, such as activated carbon particles.

Manufacturers in the Tobacco Industry are seeking to develop means of selective filtration in order to reduce the levels of certain constituents of cigarette smoke, without adversely affecting the desirable taste characteristics associated with the use of cellulose acetate filters. For this purpose, the), have devised various constructions of filter rods, involving in many cases the use of porous particles having adsorbent surfaces, particularly activated carbon particles. The inclusion of such particles in a filter rod can have a major impact on the efficiency of the filter, but significant problems are associated with the inclusion of these particles.

One approach has been to have a multi-section filter in which carbon particles are confined to an inner section of the filter, with the part of the filter which, in use, is positioned within the mouth of a user, being a standard cellulose acetate filament filter. In a triple-section filter, for example, the middle section may comprise a bed of loose carbon particles. The use of loose carbon particles can give rise to a manufacturing problem of having to control the unwanted escape of fine particles as dust clouds. In addition, if not sufficiently compacted a bed of particles in the cigarette filter may be by-passed as a filtration medium due to channelling of the smoke stream passing through it.

Another approach, is to incorporate carbon particles into a filter tow in such a way that they become attached to the surfaces of the filaments.

Early efforts to achieve this concentrated on adhering the carbon particles to the filaments through use of plasticizers or adhesives sprayed onto the tow. U.S. Pat. No. 2,881,770 and U.S. Pat. No. 3,101,723 describe processes of this type and highlights a problem of deactivation of the carbon particles by the plasticiser or the adhesive.

A more recent attempt to avoid deactivation is described in WO 03/047836. Fine, dry carbon powder is blown onto the filament surfaces of a filter tow. These surfaces have shaped micro-cavities, which are said to hold the powder in place without the need for any deactivating adhesive. However, in this case the lack of adhesion of the particles can give a greater risk of particle shedding during manufacture and use. Also, the handling of dry powder may require measures to be taken to prevent unwanted escape of powder as dust clouds.

A further development is to treat the uncrimped towband with a dispersion of fine particles. The dispersion contains an adhesive to bond the particles to the tow. Following the crimping process the fibres are dried and conditioned. This drying process prevents the deactivation of the particles.

Such a process is described in our co-pending European patent application No. EP 04251322.6, the contents of which are incorporated herein by reference.

In such a process the applied dispersion may permeate the interfilamentary spaces in the tow band, effectively "gluing" the fibres together. This potentially prevents the tow from fully opening or blooming on the rod maker and may lead to variable filter rods.

In addition, the particles trapped between the fibres are more prone to being released or shed during processing of the tow through the rod maker.

Further, when the entire tow band is treated in this way, it can be difficult to uniformly coat individual fibres forming the filter tow due to the interaction of neighbouring fibres.

This is because the geometrical shape of the fibres means that surfaces of the fibres overlap to form overlap regions, as shown in FIG. 1. These overlap regions prevent a uniform ingress of the carbon particles. In addition the towband acts as a filter so that the particles that are applied on the outside of the towband may not penetrate to the centre.

Another known process is to treat each fibre individually in such a way that there is no excess additive present. A known method of this type includes the step of including an additive in the acetate spinning solution ("dope").

In this process all the added carbon is incorporated within the bodes of each filament as shown in FIG. 2. This inclusion prevents the carbon from leaving the fibre. However, the inclusion also prevents any materials from being adsorbed onto the carbon.

An advantage of this method is that the amount of active ingredient eliminated or shed during processing of the tow is negligible. In addition the tow opens or blooms well on the rod maker, since there is no adhesive applied to the tow bands. Each fibre effectively behaves like a standard acetate fibre.

A disadvantage of this known method is, however, that the activity of the added materials is reduced to such an extent that the product yields a filtration performance that is not significantly different to that of untreated acetate. This is because the particles are coated with cellulose acetate. In addition, during extrusion the shear flow of the extruded field tends to force particles away from the edge of the fibres towards the centre of the fibres.

According to a first aspect of the present invention there is provided a method for forming a polycomponent fibre comprising a first, fibre-forming component comprising a polymer, and a second component comprising an active ingredient that will selectively reduce or remove components of tobacco smoke, the method comprising the steps of:

i. forming a dispersion, second solution or liquid comprising the second component;

ii. coextruding the first component and the dispersion, second solution or liquid through a jet or aperture to form a fibre comprising a first portion formed from the first component, and a second portion formed from the active ingredient.

An advantage of the present invention is that an active ingredient may be added to a polymer to form a polycomponent fibre in such a way that the active ingredient is added in a form that is either polymer free or has a very low polymer content.

The inventors are of the opinion that the inclusion of a polymer in the second component may result in poisoning or skinning over of the active ingredient. This adverse effect may be more severe if the second component is formed from a polymer that is fibre or film forming.

By means of the present invention therefore an active ingredient may be directly added to the first component in such a way that the active ingredient remains active following the process of forming the polycomponent fibre.

Advantageously, the method is for forming a plurality of polycomponent fibres.

Preferably, the method further comprises the step of drying the or each fibre after extrusion.

Conveniently, the method further comprises the step of combining the plurality of polycomponent fibres to form a so-called end.

A plurality of ends are then subsequently combined and crimped in a known manner to form a filter tow.

The filter tow is eventually opened or bloomed on a rod maker in order to form a filter rod for a cigarette.

By means of the present invention, a more even distribution of active ingredients may be coated onto the polymer comprising the first component of the polycomponent fibre. In addition, because individual fibres are coated with the active ingredient using a coextrusion method, the individual fibres are dry before they come into contact with one another. This eliminates or reduces any sticking together of adjacent fibres, and allows a filter tow formed from the fibres to substantially fully open on a rod maker. This in turn results in more uniformity in the resulting filter.

Advantageously, the step of drying the polycomponent fibre comprises passing the or each fibre through a heated chamber.

Conveniently, the or each fibre is heated to a temperature between 40 and 150 degrees centigrade.

Preferably, the method comprises the initial step of forming a first solution comprising the first component. In such an embodiment of the invention, the first solution shill be coextruded with the dispersion second solution or liquid comprising the active ingredient.

Advantageously, the first component comprises an acetate polymer, and the second component comprises an active ingredient comprising one or more of:

activated carbon;

ion exchange resin;

zeolite.

Advantageously, the first solution and the dispersion, second solution, or liquid each comprise acetone.

Conveniently, a plurality of components are coextruded through a jet or aperture to form a fibre having a plurality of portions.

According to a second aspect of the present invention there is provided an apparatus for forming a polycomponent fibre comprising a first, fibre forming component comprising a polymer, and a second, component comprising an active ingredient, that will selectively reduce or remove components of tobacco smoke, the apparatus comprising a first reservoir for containing the first component, a second reservoir for containing a dispersion, second solution or liquid comprising the second component;

a polycomponent spinnerette adapted to coextrude the first component and the second component to form a polycomponent fibre;

a first conduit for connecting the first reservoir to the spinnerette;

a second conduit for connecting the second reservoir to the spinnerette.

Advantageously, the spinnerette comprises a plurality of apertures or jets, preferably 2 to 600 apertures, and more preferable 100-400 apertures.

The apertures may be any desired shape to produce a particular cross-sectional shape of fibre. In addition, the jets may be formed with internal features such as partitions to yield different features in the cross section.

Preferably the apparatus further comprises a heating chamber for heating the polycomponent fibre formed after extrusion through the spinnerette.

Preferably, the apparatus further comprises combining means for combining the plurality of fibres to form an end.

Advantageously, the polycomponent fibre further comprises a third component, and the apparatus comprises a third reservoir for containing the third component, and a third conduit for connecting the third reservoir to the spinnerette, the spinnerette being adapted to coextrude the first, second and third components.

Conveniently, the polycomponent fibre comprises a plurality of components, and the apparatus comprises a plurality of reservoirs, each reservoir being adapted to contain a component, and a plurality of conduits for connecting each of the reservoirs to the spinnerette, the spinnerette being adapted to coextrude the plurality of components.

According to a third aspect of the invention there is provided a polycomponent fibre comprising a first, fibre forming component comprising a polymer, and a second, component that contains an active ingredient that will selectively reduce or remove components of tobacco smoke.

Advantageously, the second component comprises a non-polymer component.

The active ingredient may comprise particles, a liquid or a solution. If the active ingredient comprises particles it may be supplied as:

a dispersion with no other polymeric phase present;

a dispersion with an adhesive component that comprises a non-fibre forming polymer; or a dispersion with an adhesive component that comprises a fibre forming polymer.

Advantageously, the polycomponent fibre comprises an acetate fibre.

Advantageously the first component comprises a cellulose diacetate polymer.

Advantageously, the first component is contained in a solution. Preferably, the solution is an acetate solution comprising 10 to 40% by weight of cellulose diacetate in a 96.5:3.5 acetone water solution.

As mentioned hereinabove, cellulose acetate is generally used to form a filter for use in a cigarette, although other types of polymer such as viscose, polyesters and polyolefins could be used as the first component.

Advantageously, the first component further comprises a pigment preferably titanium oxide ($TiO_2$) which provides opacity to the filament.

Alternatively or additionally, the first component may include a plasticiser in the form of, for example, triacetin. The plasticiser may assist with the bonding of the active ingredient.

Preferably, the active ingredient comprises particles comprising one or more of: activated carbon; ion exchange resins; zeolites.

Advantageously, the particle size falls within the range 0.01 to 20 microns. The particle size is dependent on the particular active ingredient. When the active ingredient comprises carbon, the particle size is preferably less than 5 μm. When the active ingredient comprises an acrylic emulsion the particle size is of the order of 100 nm.

The second component may comprise a dispersion comprising a dispersant and the active ingredient.

Advantageously, the dispersant comprises a volatile solvent, preferably an acetone/water mix.

Preferably, the dispersion concentration will be in the range 0.1% to 60% particles.

Advantageously, the dispersion comprises a dispersion additive. The additive may be, for example a surfactant, humectant or bonding agent.

Alternatively the second component comprises a solution of the active ingredient.

Alternatively, the second component comprises a liquid.

The polycomponent fibre may comprise a third component.

Advantageously the third component comprises an adhesive, or viscosity modifying substance.

The adhesive or viscosity modifying substance may be any convenient substance, for example, PVOH, PVA, methylated/proprinated methyl cellulose, PVP.

The adhesive may be present as an acetone/water based dispersion or solution.

The adhesive may be formed separately from both the first and second components, or may form part of either the first, or the second component.

However, an adhesive may not always be necessary, since under certain circumstances the active ingredient may bond directly with the first component.

Advantageously, the third component comprises a second active ingredient.

The polycomponent fibre may comprise a plurality of further components such as one or more active ingredients and/or adhesive.

The invention will now be further described by way of example only with reference to the accompanying drawings in which.

Figure 3:
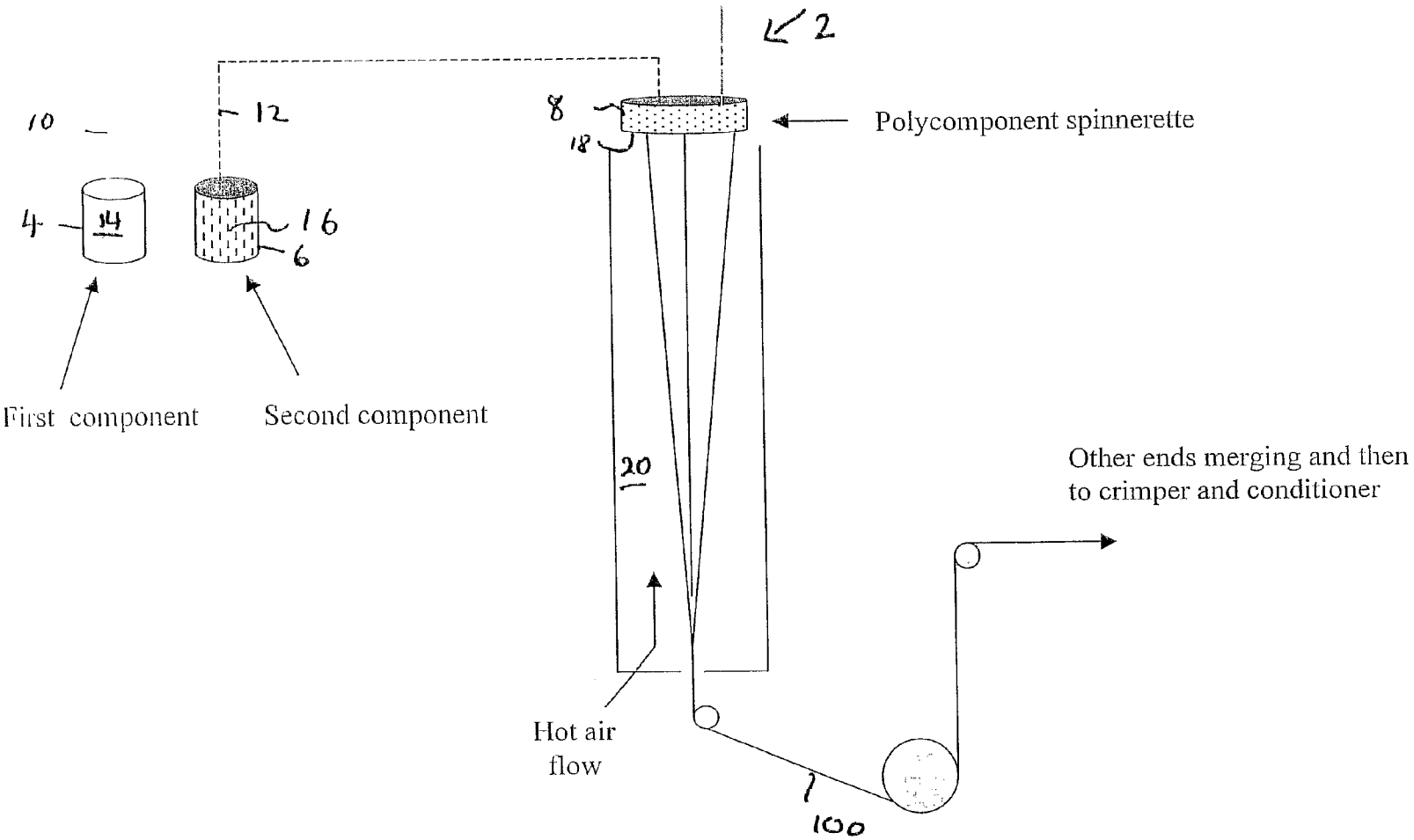
FIG. 3 is a schematic representation of an apparatus according to the second aspect of the present invention used for forming a polycomponent fibre according to the first aspect of the present invention.

FIGS. 5*a* to 5*g* are schematic representations of possible shapes of apertures forming part of spinnerette of the apparatus of FIG. 3 for forming a bicomponent fibre;

FIGS. 6*a* to 6*c* show further possible shapes of apertures forming part of the spinnerette of the apparatus of FIG. 3 for forming a bicomponent fibre; and FIGS. 7*a* and 7*b* are cross-sectional representations of further possible shapes of apertures of a spinnerette forming part of the apparatus of FIG. 3 for forming a tricomponent fibre.

Figure 1:
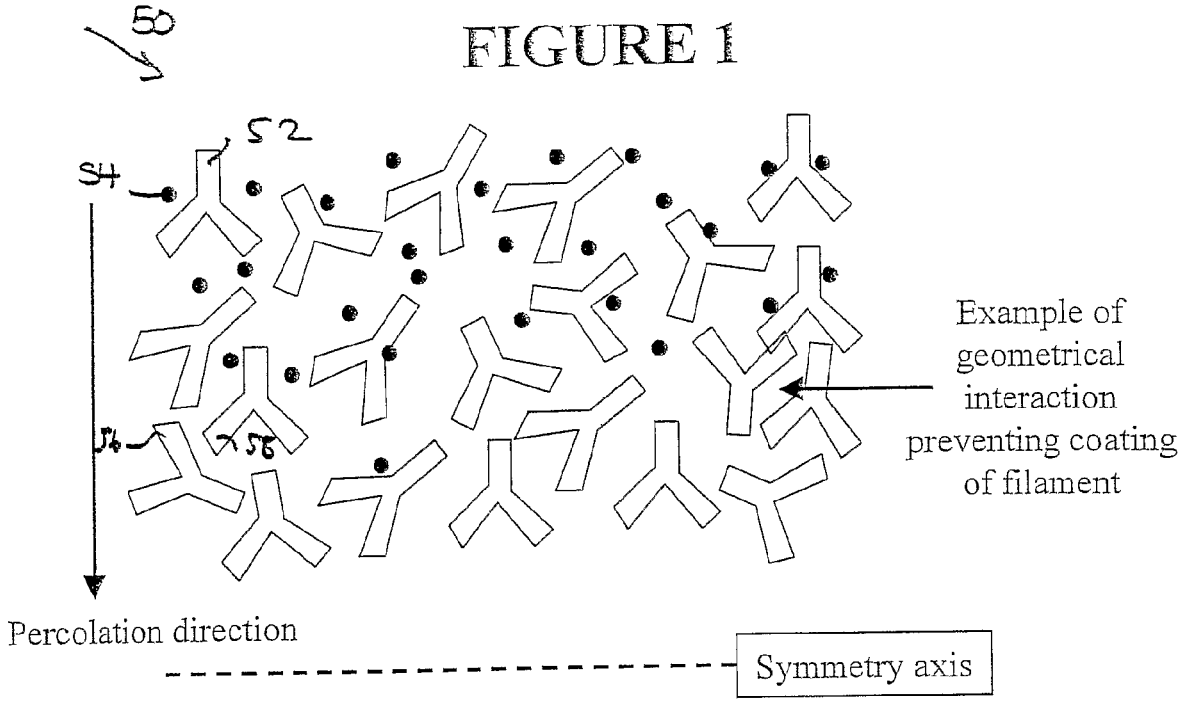
FIG. 1 is a schematic representation of fibres forming a tow band formed using a known process in which there are overlap regions in the surfaces of neighbouring fibres.

Referring to FIG. 1, a schematic representation of a known filter tow 50 is represented. The filter tow 50 comprises a plurality of fibres 52 each of which has a trilobal cross-sectional configuration. An active ingredient such as activated carbon 54 is added to the filter tow by treating the entire tow band after formation of the tow band. Under such circumstances, it can be difficult to uniformly coat individual fibres due to the interaction of neighbouring fibres. As can be seen from FIG. 1, portions of neighbouring fibres such as portions 56 and 58 overlap thus preventing carbon particles from coating the overlapping portions of the fibres.

Figure 2:
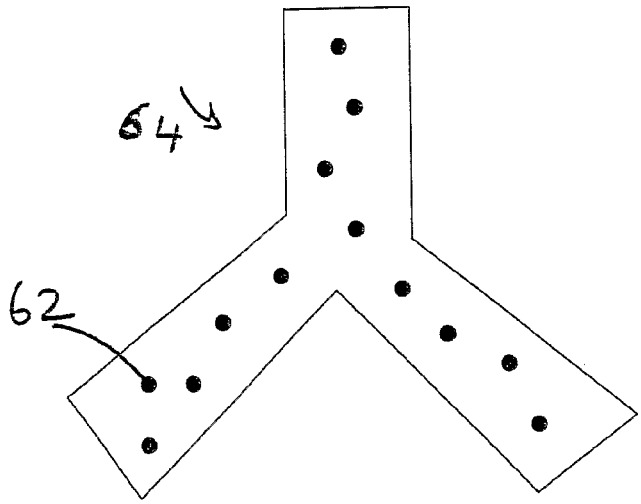
FIG. 2 is a schematic representation showing the incorporation of active particles inside a fibre formed using a known process.

Turning now to FIG. 2, a schematic representation of a known filament 64 in a tow band is shown. The filament 64 has been formed by including an additive in the acetate spinning solution. This known method results in the added active ingredient 62 being incorporated within the body of each fibre. The active ingredient 62 is thus trapped within the body of the fibre thus significantly reducing the efficacy of the active ingredient.

Referring to FIG. 3, an apparatus for forming a polycomponent fibre 100 according to the present invention is designated generally by the reference numeral 2. The polycomponent fibre comprises a first fibre forming component 14 comprising a polymer, and a second, component 16 comprising an active ingredient. The apparatus 2 comprises a first reservoir 4 for containing a solution of the first component, and a second reservoir 6 for containing a solution, liquid or dispersion of the second component.

In the example illustrated in FIG. 3 the apparatus 2 is adapted to form a polycomponent fibre based upon cellulose acetate. The first reservoir 4 therefore contains within it a cellulose diacetate dope.

The second reservoir 6 contains a dispersion, liquid or solution containing the active ingredient. In this example, the active ingredient comprises a plurality of activated carbon particles dispersed in an acetone/water solution. Activated carbon particles are known to be porous particles having absorbent/adsorbent surfaces.

Preferably, the porosity of the carbon particles is within the range 200 to 3000 $gm^2$, more preferably within the range 800-1250 $gm^2$.

Typically, the carbon particles will have been pre-soaked for 2 to 40 hours in a dispersant to form the dispersion. By presoaking carbon particles in dispersion, it is possible to pre-treat carbon particles in such a way as to load them with a material capable of generating a gaseous omission from the particles. This allows the carbon particles to remain active even after the application of adhesive, since gaseous emissions from within the particles, force adhesive off parts of the external surfaces of the particles so as to open up access to the internal surfaces. Such a process is known as the "volcano" activation of the carbon particles.

Typically, the size of the carbon particles will be in the range of 0.01 to 20 microns.

Typically, the dispersion concentration will be in the range of 5 to 60% particles in the dispersion.

The dispersant may be any convenient dispersant such as an acetone/water mix or any other volatile solvent.

Further additives may be added to the dispersant to enhance the bonding of the active ingredient to the first component. Suitable additives may be: surfactants; humectants; or bonding agents for example, Triacetin; or glycerol.

The apparatus comprises a spinnerette 8 comprising a plurality of apertures or jets 18 for forming fibres 100. An example of a spinnerette 8 is shown in more detail in FIG. 4.

Figure 4:
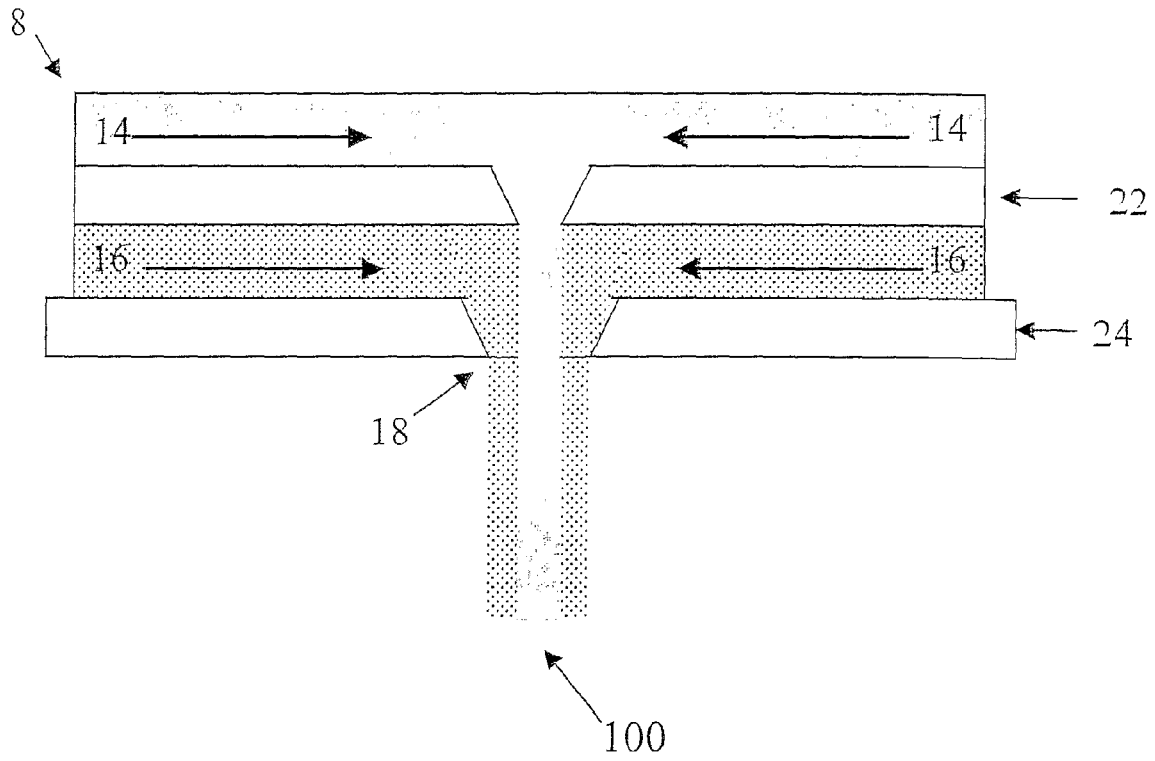
FIG. 4 is a cross-sectional representation of a spinnerette forming part of the apparatus of FIG. 3.
Figure 4:
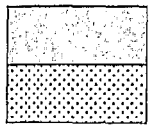

The spinnerette 8 comprises a first plate 22 adapted to receive the solution comprising the first component from the first reservoir, and a second plate 24 adapted to receive the solution, dispersion or liquid containing the second component 16, from the second reservoir 6. The two components 14, 16 are coextruded through a plurality of jets or apertures 18 (only one of which is shown in FIG. 4) to produce a polycomponent fibre which in this case is a bicomponent fibre.

The apparatus further comprises a first conduit 10 for connecting the first reservoir to the spinnerette 8, and a second conduit 12 for connecting the second reservoir 6 to the spinnerette 8.

The spinnerette 8 is adapted to coextrude the first component 14 and the second component 16.

The ratio of the dispersion flow rate of the second component to the flow rate of the first component, and the concentration of the streams of the first and second component will result in a particular particle loading level. The particle loading level should be 2% to 60%, and preferably 10%-40%.

Qa=flow rate of the acetate dope ($gs^{-1}$)

Qd=flow rate of dispersion ($gs^{-1}$)Ca=concentration of acetate in the dope (weight %)

Cd=concentration of active species in the dispersion (weight %)

The level of the active material on cellulose acetate, L is given by $$L = \frac{Q_d C_d}{Q_a C_a} \cdot 100$$

The resultant polycomponent fibre may have a cross-sectional geometry in which the core is formed form the first component, and a sheath surrounding the core is formed from the second component. Alternatively, the filament may be segmented with alternating segments of first and second components.

The cross-sectional shape of the fibre may be any one of a number of different designs, for example, crenellated, Y, X, dogbone, multilobal etc.

Figure 5:
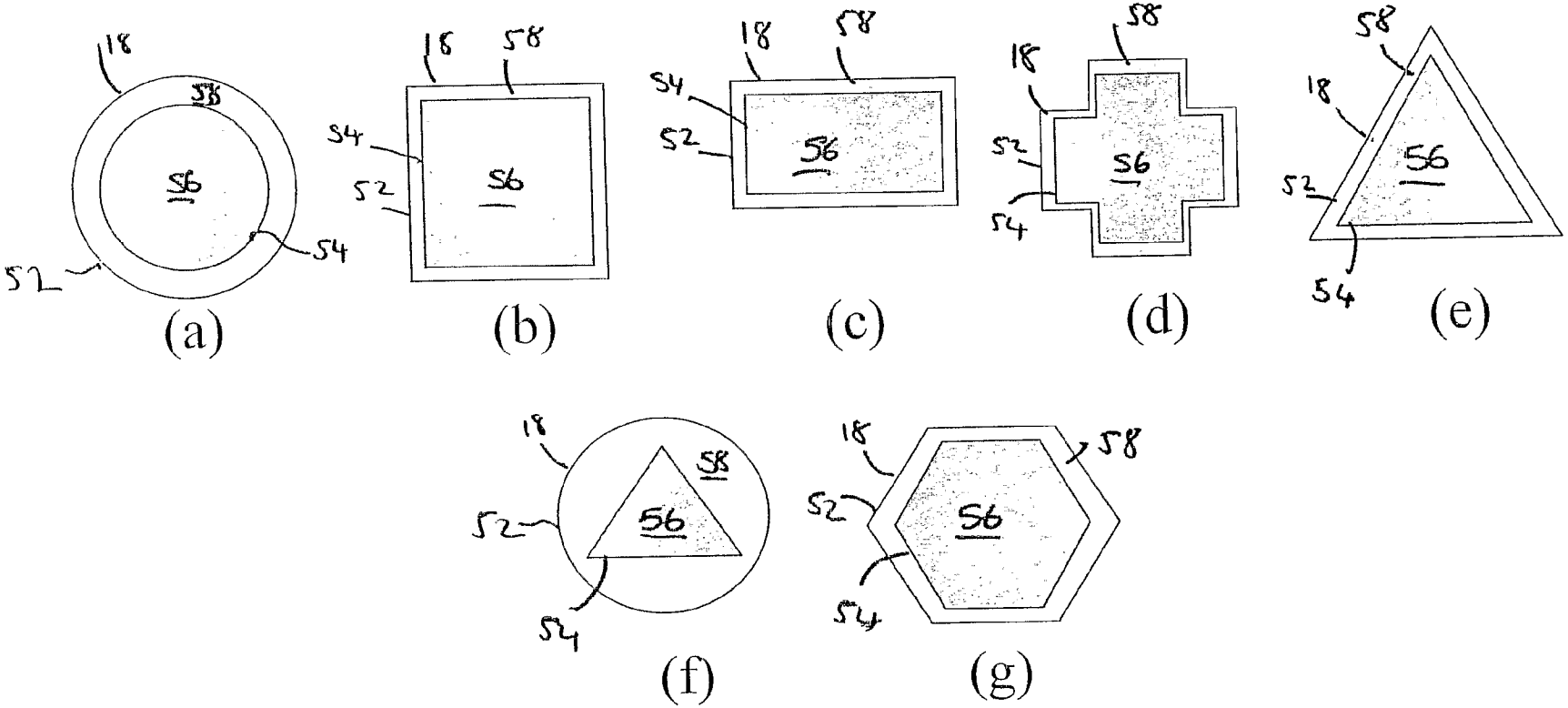
Figure 6:
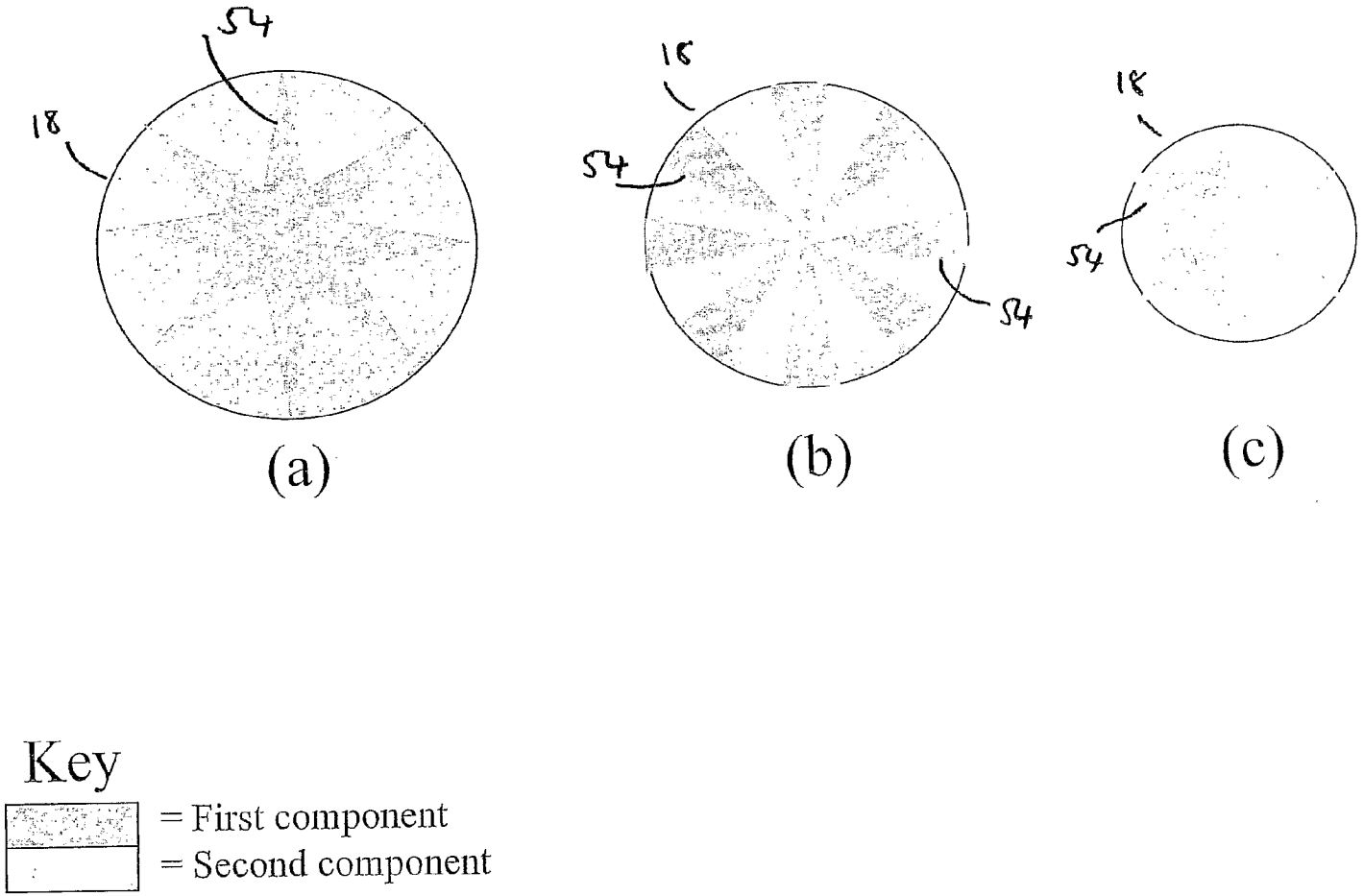
Figure 7:
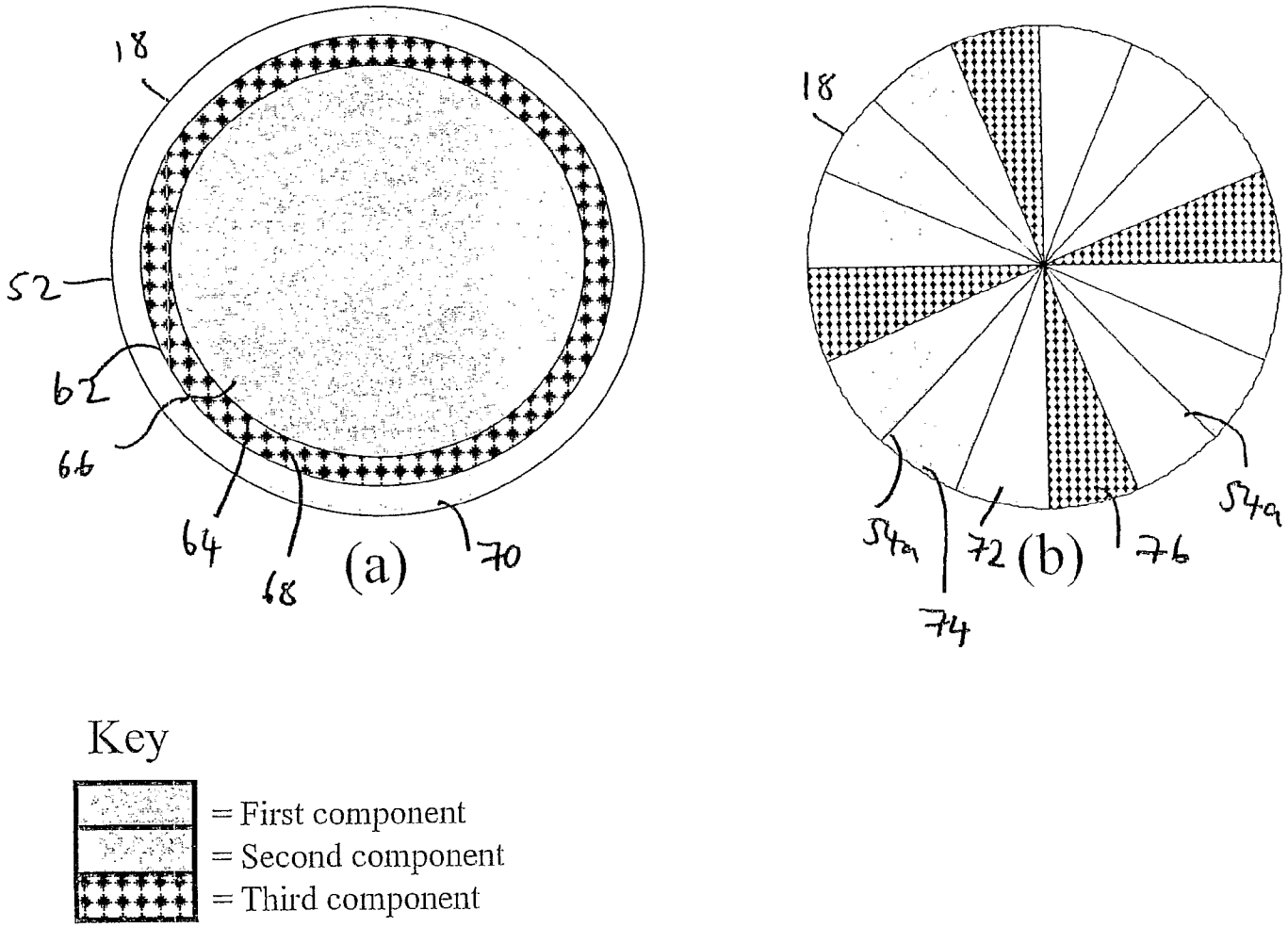

Other geometries of the first and second components are also envisaged as can be seen from the examples of shapes of spinnerette apertures shown in FIGS. 5, 6 and 7.

Referring to FIGS. 5*a* to 5*g*, possible shapes of aperture 18 forming part of a spinnerette 8 and suitable for forming a bicomponent fibre. The embodiments of the aperture 18 shown in FIGS. 5*e* to 5*g* comprise an outer wall 52, and an inner partition 54. The inner partition defines an inner area 56, and the outer wall 52 and the inner partition 54 together form an outer area 58. In use, the first component will be extruded through the region 56, and the second component will be extruded through the region 58.

Turning now to FIGS. 6*a* and 6*b*, further embodiments of an aperture 18 forming part of spinnerette 8 are shown. The embodiments of the aperture 18 shown in FIGS. 6*a* and 6*b* are also suitable for forming a bicomponent fibre. However, a bicomponent fibre formed by the apertures shown in these figures will have an inner portion extending to the outer parameter of the fibre.

In FIG. 6*b* in particular, the inner partition 54 comprises a plurality of partition portions 54*a*.

Turning now to FIGS. 7*a* and 7*b*, an aperture 18 suitable for forming a tricomponent fibre is schematically illustrated.

Turning initially to FIG. 7*a*, the aperture 18 comprises an outer wall 52, a first inner wall 62, and second inner wall 64. The outer wall 52 and inner walls 62 and 64 define an inner region 66, intermediate region 68 and outer region 70. In use, a first component will be extruded through region 66, a second component will be extruded through region 68, and third component will be extruded through region 40.

Turning now to the aperture 18 shown in FIG. 7*b*, the aperture 18 comprises an outer wall 52 and a plurality of inner walls 54*a*. The inner walls 54*a* together with the outer wall 52 comprise a first set of regions 72, a second set of regions 74 and a third set of regions 76.

In use, a first component would be extruded through each of the regions 72, a second component would be extruded through each of the regions 74, and a third component would be extruded through each of the regions 76.

It is to be understood that the shapes of apertures illustrated in FIGS. 5, 6 and 7 are illustrative examples only, and any other convenient shape of aperture may be used.

After extrusion through the spinnerette, the fibres 100 are drawn, and pass through a chamber 20 containing hot air. The hot air drives the loss of the volatile solvents yielding a solid filament from the extruded solution. The process may also activate any adhesive present in the components forming the fibres 100.

The size and shape of the fibres will be determined by the size of apertures of the spinnerette 8, and also by the flow rates, draw down ratio, concentrations and to a lesser extent by air and dope temperatures and air velocity.

The spinnerette comprises from 20 to 600 apertures, 18, thus forming 20 to 600 fibres.

The design of the spinnerette 8 will be governed by the necessity of maintaining an active, fixed coating and robust spinning performance. The spinning performance is defined by the number of fibre breakages for a given mass of formed fibre. This performance is typically expressed as Incidents per tonne (IPT). The relationship between process parameters and IPT is complex, but is understood to depend on draw down ratio, spinning speed, concentration, air velocity, air temperature, filament size etc.

The size of the fibre will generally fall within the range of 0.1 to 40 denier per fibre.

In order to optimise the extrusion conditions to result in robust productive spinning of the polycomponent fibres, the following parameters will be adjusted: The concentration, flow rate, viscosity and draw down ratio of all the components subject to the constraint that the required loading on fibre is maintained. In addition, the chamber air temperatures, chamber air humidity, chamber air flow rates and directions, chamber length and cross sections and extrusion, or spinning speeds (take up speed) may also be varied.

These parameters together with the compositions and temperatures of the extrusion streams will generate solution/dispersion rheological properties, including viscosities, and spinning pressures.

In certain processes carried out using the apparatus 2, the extrusion of the first component 14 will start before extrusion of the second component 16, in order to aid the start up of the spinnerette. A bicomponent fibre is more difficult to spin than a single component fibre. If, however, good spinning of the acetate fibre is achieved before applying the second component, it is believed that the start up process will be aided.

The polycomponent fibre may comprise two, three, four or more different components.

The polycomponent fibre may comprise two or more types of active ingredient.

Groups of fibres (ends) produced using the apparatus of FIG. 3 may be treated with spin finish.

A spin finish is a material that is applied to fibre to modify the frictional and static properties of the fibre. In the illustrated embodiment, a white oil (as an oil in water emulsion) is added to the fibre. This reduces the static and reduces the fibre metal function. The lower friction leads to less fibre damage.

An end is a group of fibres (typically 100-300) that have been spun from the same jet/spinning cell. There are typically 50 spinning cells in a filter tow production line so the resulting tow, band consists of 50 ends.

Further treatment of the coated fibres may take place. For example, they may undergo additional heat treatment.

The resulting ends will be combined into a tow band. Other fibres may be treated using the same apparatus and process, possibly with different dispersions and the resulting ends may be combined into a single tow band. The tow band may also contain standard cellulose acetate filaments.

The resulting tow band is crimped, conditioned, plaited and formed into a bale in preparation for conversion into filter rods on a rod maker.

If it is desired to form a polycomponent fibre having more than two components, then a suitable number of additional plates are added to spinnerette.

The invention claimed is:

1. A method for forming a polycomponent fibre comprising a first, fibre-forming component comprising a polymer, and a second component comprising an active ingredient that will selectively reduce or remove components of tobacco smoke, the method comprising the steps of:

i. forming a dispersion, second solution or liquid comprising the second component and a solvent; and ii. coextruding the first component and the dispersion, solution or liquid through a jet or aperture to form a fibre comprising a first portion formed from the first component, and a second portion formed from the second component, and iii) drying the or each fibre after extrusion, thereby driving the solvent from the second component to form the second portion of the fibre.

2. A method according to claim 1 for forming a plurality of polycomponent fibres.

3. A method according to claim 1 wherein the step of drying comprises passing the or each fibre through a heating chamber.

4. A method according to claim 1 wherein the step of drying the or each fibre comprises heating the or each fibre to a temperature of 20 to 150 degrees centigrade.

5. A method according to claim 2, comprising the further step of:

iv) combining the plurality of fibres to form an end.

6. A method according to claim 1 wherein the method comprises the initial step of:

v) forming a first solution comprising the first component.

7. A method according to claim 6, wherein the first component comprises an acetate polymer, and the second component comprises an active ingredient comprising one or more of: activated carbon; ion exchange resin; zeolite.

8. A method according to claim 6 wherein the first solution comprises acetone.

9. A method according to claim 1 wherein a plurality of components are coextruded through a jet or aperture to form a fibre having a plurality of portions.

10. A method according to claim 1 wherein the solvent comprises acetone.

* * * * *